US010157582B2

(12) United States Patent
Matsui

(10) Patent No.: US 10,157,582 B2
(45) Date of Patent: Dec. 18, 2018

(54) DISPLAY DEVICE, GRADATION CORRECTION MAP GENERATION DEVICE, GRADATION CORRECTION MAP GENERATION METHOD, AND PROGRAM

(71) Applicant: NEC Display Solutions, Ltd., Tokyo (JP)

(72) Inventor: Katsuyuki Matsui, Tokyo (JP)

(73) Assignee: NEC DISPLAY SOLUTIONS, LTD., Tokyo (JP)

( * ) Notice: Subject to any disclaimer, the term of this patent is extended or adjusted under 35 U.S.C. 154(b) by 0 days.

(21) Appl. No.: 15/318,649

(22) PCT Filed: Aug. 28, 2014

(86) PCT No.: PCT/JP2014/072531
§ 371 (c)(1),
(2) Date: Dec. 13, 2016

(87) PCT Pub. No.: WO2016/031006
PCT Pub. Date: Mar. 3, 2016

(65) Prior Publication Data

US 2017/0116931 A1 Apr. 27, 2017

(51) Int. Cl.
*G09G 3/36* (2006.01)
*G09G 3/00* (2006.01)

(52) U.S. Cl.
CPC ..... *G09G 3/36* (2013.01); *G09G 3/006* (2013.01); *G09G 2320/0233* (2013.01);
(Continued)

(58) Field of Classification Search
CPC ..... G09G 3/36; G09G 5/02; G06T 11/001
(Continued)

(56) References Cited

U.S. PATENT DOCUMENTS 7,417,776 B2 8/2008 Baba et al.
2005/0185233 A1* 8/2005 Baba ..... G11B 7/0065 359/9
(Continued)

FOREIGN PATENT DOCUMENTS

CN 1918919 A 2/2007
CN 101038734 A 9/2007
(Continued)

OTHER PUBLICATIONS

International Search Report (ISR) (PCT Form PCT/ISA/210), in PCT/JP2014/072531, dated Dec. 2, 2014.
(Continued)

*Primary Examiner* — Jin Ge
(74) *Attorney, Agent, or Firm* — McGinn I.P. Law Group, PLLC.

(57) ABSTRACT

A display device includes a video input unit that receives a video signal; a display control unit that corrects the video signal; and a display unit that has a screen on which a video according to the corrected video signal is displayed. The display device further includes a gradation correction map generation device that generates a gradation correction map which indicates a corresponding relationship between a plurality of positions on the screen and a correction value for gradation of the video signal at each of the positions; the gradation correction map generation device generates the gradation correction map according to a luminance unevenness map which indicates a corresponding relationship between the plurality of the positions and uncorrected luminance, which is luminance when correction is not performed, at each of the positions, and a second gamma characteristic which indicates a corresponding relationship between luminance at a specific position on the screen.

10 Claims, 11 Drawing Sheets

(52) U.S. Cl.
CPC ..... *G09G 2320/0271* (2013.01); *G09G 2320/0276* (2013.01); *G09G 2320/0285* (2013.01); *G09G 2320/041* (2013.01)

(58) Field of Classification Search
USPC ..... 345/589
See application file for complete search history.

(56) References Cited

U.S. PATENT DOCUMENTS

| | | | | |
|---|---|---|---|---|
| 2006/0066643 | A1* | 3/2006 | Arai | G09G 3/2044 345/690 |
| 2006/0214940 | A1* | 9/2006 | Kinoshita | G09G 3/2096 345/589 |
| 2010/0253709 | A1* | 10/2010 | Kobayashi | G09G 3/2007 345/690 |
| 2011/0057967 | A1* | 3/2011 | Adachi | G09G 3/006 345/690 |
| 2011/0141149 | A1* | 6/2011 | Inoue | G09G 3/3233 345/690 |
| 2013/0016138 | A1* | 1/2013 | Sasaki | G09G 3/3648 345/690 |
| 2014/0035962 | A1* | 2/2014 | Izumi | G09G 3/30 345/690 |
| 2015/0002564 | A1* | 1/2015 | Sugimoto | G09G 3/2014 345/698 |
| 2016/0005348 | A1* | 1/2016 | Yanagi | G09G 3/20 345/600 |

FOREIGN PATENT DOCUMENTS

| | | | |
|---|---|---|---|
| CN | 101627408 | A | 1/2010 |
| CN | 101960512 | A | 1/2011 |
| CN | 101971243 | A | 2/2011 |
| JP | 2005-250265 | A | 9/2005 |
| JP | 2008-042843 | A | 2/2008 |
| JP | 2009-271501 | A | 11/2009 |
| JP | 4530200 | B2 | 6/2010 |
| WO | WO 2011/125374 | A1 | 10/2011 |

OTHER PUBLICATIONS

Chinese Office Action dated Jun. 25, 2018 with an English translation.

* cited by examiner

FIG. 3

<GRADATION CORRECTION BASIC MAP>

| GRADATION | POSITION ON SCREEN OF DISPLAY UNIT 108 | | GRADATION CORRECTION VALUE |
|---|---|---|---|
| | x | y | |
| 255 | x1 | y1 | 230 |
| | x1 | y2 | 225 |
| | ... | ... | ... |
| | x20 | y11 | 235 |
| 192 | x1 | y1 | 178 |
| | ... | ... | ... |
| 128 | x1 | y1 | 110 |
| | ... | ... | ... |
| 64 | x1 | y1 | 58 |
| | ... | ... | ... |
| 0 | x1 | y1 | 0 |
| | ... | ... | ... |

FIG. 7

<GRADATION CORRECTION MAP>

| GRADATION | POSITION ON SCREEN OF DISPLAY UNIT 108 | | GRADATION CORRECTION VALUE |
|---|---|---|---|
| | x | y | |
| 255 | x1 | y1 | 234 |
| | x1 | y2 | 228 |
| | ... | ... | ... |
| | x20 | y11 | 238 |
| 192 | x1 | y1 | 180 |
| | ... | ... | ... |
| 128 | x1 | y1 | 113 |
| | ... | ... | ... |
| 64 | x1 | y1 | 60 |
| | ... | ... | ... |
| 0 | x1 | y1 | 1 |
| | ... | ... | ... |

DISPLAY DEVICE, GRADATION CORRECTION MAP GENERATION DEVICE, GRADATION CORRECTION MAP GENERATION METHOD, AND PROGRAM

TECHNICAL FIELD

The present invention relates to a display device, a gradation correction map generation device, a gradation correction map generation method, and a program.

BACKGROUND ART

For displays utilized in a graphic design field or the like, a display performance of reproducing uniform colors over the entire screen is required.

Patent Document 1 discloses a related technique for correction of luminance unevenness or color unevenness.

In an image display apparatus disclosed in Patent Document 1, an input video signal is displayed on a display panel. This image display apparatus inputs a white (color) signal of approximately 100% white level onto the display panel which displays this signal. The displayed white screen is imaged by using an imaging device, and the image display apparatus has a computation device of computing a reciprocal of a luminance signal and/or a color signal obtained by the imaging. The image display apparatus also has (i) a memory utilized to store the reciprocal computed by the computation device as correction data, and (ii) a correction device that corrects luminance unevenness and/or color unevenness generated on the display panel by multiplying the correction data stored in the memory by the input video signal.

Accordingly, in the image display apparatus disclosed in Patent Document 1, a white signal, for example, 100 IRE (100% white level) is displayed on a liquid crystal panel, and the displayed white screen is imaged by using the imaging device so as to detect luminance unevenness or color unevenness for the white screen, which is generated on the display screen of the liquid crystal panel, as a level difference in the output video signal for the luminance or color. Then, a reciprocal of the video signal having the level difference detected by using the imaging device is multiplied by the video signal input into the liquid crystal display apparatus, so as to perform the correction to obtain uniform luminance or color.

PRIOR ART DOCUMENT

Patent Document

Patent Document 1: Japanese Unexamined Patent Application, First Publication No. 2009-271501.

DISCLOSURE OF INVENTION

Problem to be Solved by the Invention

In a display in an ordinary user environment, luminance unevenness depending on room temperature or the like remains. When the luminance unevenness of the display is corrected by using the technique disclosed in Patent Document 1, generally, the luminance unevenness must be measured by using a high-precision camera. Therefore, from a viewpoint of cost or the like, it is difficult to use the technique disclosed in Patent Document 1 in such a user environment.

Accordingly, a technique of simply correcting luminance unevenness of a display in an ordinary user environment has been required.

An object of the present invention is to provide a display device, a gradation correction map generation device, a gradation correction map generation method, and a program, which can solve the above problem.

Means for Solving the Problem

A display device according to one mode of the present invention comprises:

a video input unit that receives a video signal;

a display control unit that corrects the video signal; and a display unit that has a screen on which a video according to the corrected video signal is displayed, where the display device further comprises:

a gradation correction map generation device that generates a gradation correction map which indicates a corresponding relationship between a plurality of positions on the screen and a correction value for gradation of the video signal at each of the positions;

the gradation correction map generation device generates the gradation correction map according to:

a luminance unevenness map which indicates a corresponding relationship between the plurality of the positions and uncorrected luminance, which is luminance when correction is not performed, at each of the positions, and a second gamma characteristic which indicates a corresponding relationship between luminance at a specific position on the screen at a second point in time after a first point in time and the gradation of the video signal; and the display control unit corrects the video signal by using the gradation correction map.

A display device according to one mode of the present invention comprises:

a video input unit that receives a video signal;

a display control unit that corrects the video signal; and a display unit that has a screen on which a video according to the corrected video signal is displayed, where the display device further comprises:

a gradation correction map generation device that generates a gradation correction map which indicates a corresponding relationship between a plurality of positions on the screen and a correction value for gradation of the video signal at each of the positions;

the gradation correction map generation device generates the gradation correction map according to:

a luminance correction map which indicates a corresponding relationship between the plurality of the positions and an amount of luminance correction at each of the positions, and a second gamma characteristic which indicates a corresponding relationship between luminance at a specific position on the screen at a second point in time and the gradation of the video signal; and the display control unit corrects the video signal by using the gradation correction map.

In accordance with one mode of the present invention, a gradation correction map generation device generates a gradation correction map which indicates a corresponding relationship between a plurality of positions on a screen of a display unit and a correction value for gradation of a video signal at each of the positions, according to:

a luminance unevenness map which indicates a corresponding relationship between the plurality of the positions and uncorrected luminance, which is luminance when correction is not performed, at each of the positions, and a second gamma characteristic which indicates a corresponding relationship between luminance at a specific position on the screen at a second point in time and the gradation of the video signal.

In accordance with one mode of the present invention, a gradation correction map generation method generates a gradation correction map which indicates a corresponding relationship between a plurality of positions on a screen of a display unit and a correction value for gradation of a video signal at each of the positions, according to:

a luminance unevenness map which indicates a corresponding relationship between the plurality of the positions and uncorrected luminance, which is luminance when correction is not performed, at each of the positions, and a second gamma characteristic which indicates a corresponding relationship between luminance at a specific position on the screen at a second point in time and the gradation of the video signal.

In accordance with one mode of the present invention, a program makes a computer function as a gradation correction map generation device that generates a gradation correction map which indicates a corresponding relationship between a plurality of positions on a screen of a display unit and a correction value for gradation of a video signal at each of the positions, according to:

a luminance unevenness map which indicates a corresponding relationship between the plurality of the positions and uncorrected luminance, which is luminance when correction is not performed, at each of the positions, and a second gamma characteristic which indicates a corresponding relationship between luminance at a specific position on the screen at a second point in time and the gradation of the video signal.

Effect of the Invention

In accordance with the display device, the gradation correction map generation device, the gradation correction map generation method, and the program as described above, the gradation is corrected according to a characteristic which indicates a corresponding relationship between the gradation of a video signal and luminance at a specific position on the display unit when the luminance unevenness is corrected. Accordingly, when the luminance unevenness of the display unit is corrected, measurement of the luminance unevenness by using a high-precision camera is unnecessary. Therefore, the luminance unevenness over the entire screen of the display unit can be simply corrected.

BRIEF DESCRIPTION OF THE DRAWINGS

FIG. 3 is a diagram showing an example of data of the gradation correction basic map.

FIG. 7 is a diagram showing an example of data of the gradation correction map.

MODE FOR CARRYING OUT THE INVENTION

Below, a display device according to a first embodiment of the present invention will be explained with reference to the drawings.

Figure 1:
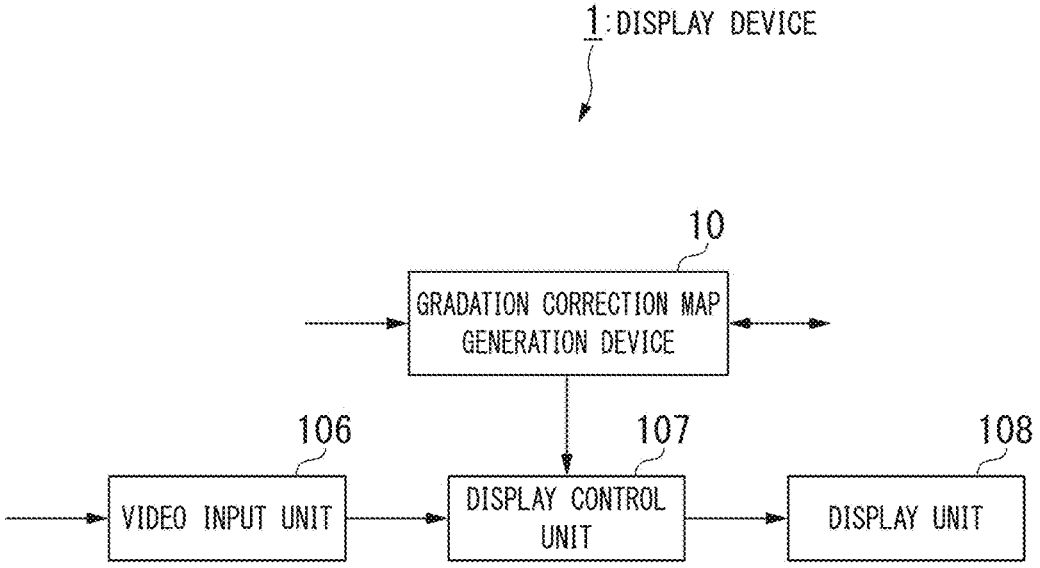
FIG. 1 is a diagram showing an example of a display device 1 according to a first embodiment of the present invention.

FIG. 1 is a diagram showing an example of a display device 1 according to the first embodiment of the present invention.

The display device 1 according to the first embodiment is an example of the display device of the present invention.

As shown in FIG. 1, the display device 1 according to the first embodiment has at least a gradation correction map generation device 10, a video input unit 106, a display control unit 107, and a display unit 108.

The gradation correction map generation device 10 provided in the display device 1 of the first embodiment generates a gradation correction map which indicates a corresponding relationship between a plurality of positions on a screen and a correction value for the gradation of the video signal at each of the positions. The gradation correction map generation device 10 generates the gradation correction map according to (i) a luminance unevenness map which indicates a corresponding relationship between the plurality of the positions and uncorrected luminance (i.e., luminance when correction is not performed) at each of the positions, and (ii) a second gamma characteristic which indicates a correspondence relationship between luminance at a specific position on the screen at a second point in time and the gradation of the video signal. Here, the uncorrected luminance is the luminance at a first point in time which is prior to the second point in time.

The video input unit 106 receives a video signal.

The display control unit 107 corrects the video signal by using the gradation correction map.

The display unit 108 has a screen to display a video according to the corrected video signal.

An amount of luminance correction is a difference or ratio between the uncorrected luminance, which is luminance at each position on the screen of the display unit 108 when the correction is not performed, and target luminance for each of the positions. Each position on the screen of the display unit 108 corresponds to each of pixels, the number of which is smaller than the total number of the pixels of the screen. For example, individual positions of 20 points in the horizontal direction×11 points in the vertical direction are employed.

A luminance correction map is a set of data which indicate a corresponding relationship between the amount of luminance correction at each position on the screen of the display unit 108 and said each position on the screen of the display unit 108.

A user measurement gamma characteristic (second gamma characteristic) indicates a corresponding relationship between the gradation of the video signal and luminance at a specific position on the screen of the display unit 108, where the luminance is obtained at the second point in time after the first point in time explained later. Here, the gamma characteristic is a set of data which indicate a corresponding relationship between the gradation of the input video signal and the luminance of the screen of the display unit 108.

The gradation correction map is generated according to the luminance correction map and the user measurement gamma characteristic and is a set of correction values for each specific gradation of the video signal at a specific position on the screen of the display unit 108. Here, the specific position is a position on the screen of the display unit 108. On a viewpoint of the degree of luminance unevenness correction, it is preferable that this specific position be identical to the position (on the screen of the display unit 108) at which the basic gamma characteristic is measured. When the gradation is corrected by using the gradation correction map, the luminance at each position on the screen of the display unit 108 is also corrected, and thus luminance unevenness is adjusted again.

Accordingly, in the display device 1 of the first embodiment, the gradation correction map generation device 10 generates the gradation correction map which indicates a corresponding relationship between a plurality of positions on the screen of the display unit 108 and a correction value for the gradation of the video signal at each of the positions. The gradation correction map generation device 10 generates the gradation correction map according to (i) the luminance unevenness map which indicates a corresponding relationship between the plurality of the positions and the uncorrected luminance (i.e., luminance when correction is not performed) at each of the positions, and (ii) the second gamma characteristic which indicates a correspondence relationship between luminance at a specific position on the screen at a second point in time and the gradation of the video signal.

The video input unit 106 receives a video signal. The display control unit 107 corrects the video signal by using the gradation correction map. The display unit 108 has a screen to display a video according to the corrected video signal.

After shipped from a factory, in order to correct the luminance unevenness over the entire screen of the display unit 108, the user measurement gamma characteristic at a position on the screen of the display unit 108 is measured. That is, it is unnecessary to measure luminance unevenness by using a high-precision camera. Therefore, it is unnecessary for the user to prepare a high-precision camera, and the luminance unevenness over the entire screen of the display unit 108 can be simply corrected in the display device 1.

Next, a display device 1*a* according to a second embodiment of the present invention will be explained with reference to the drawings.

Figure 2:
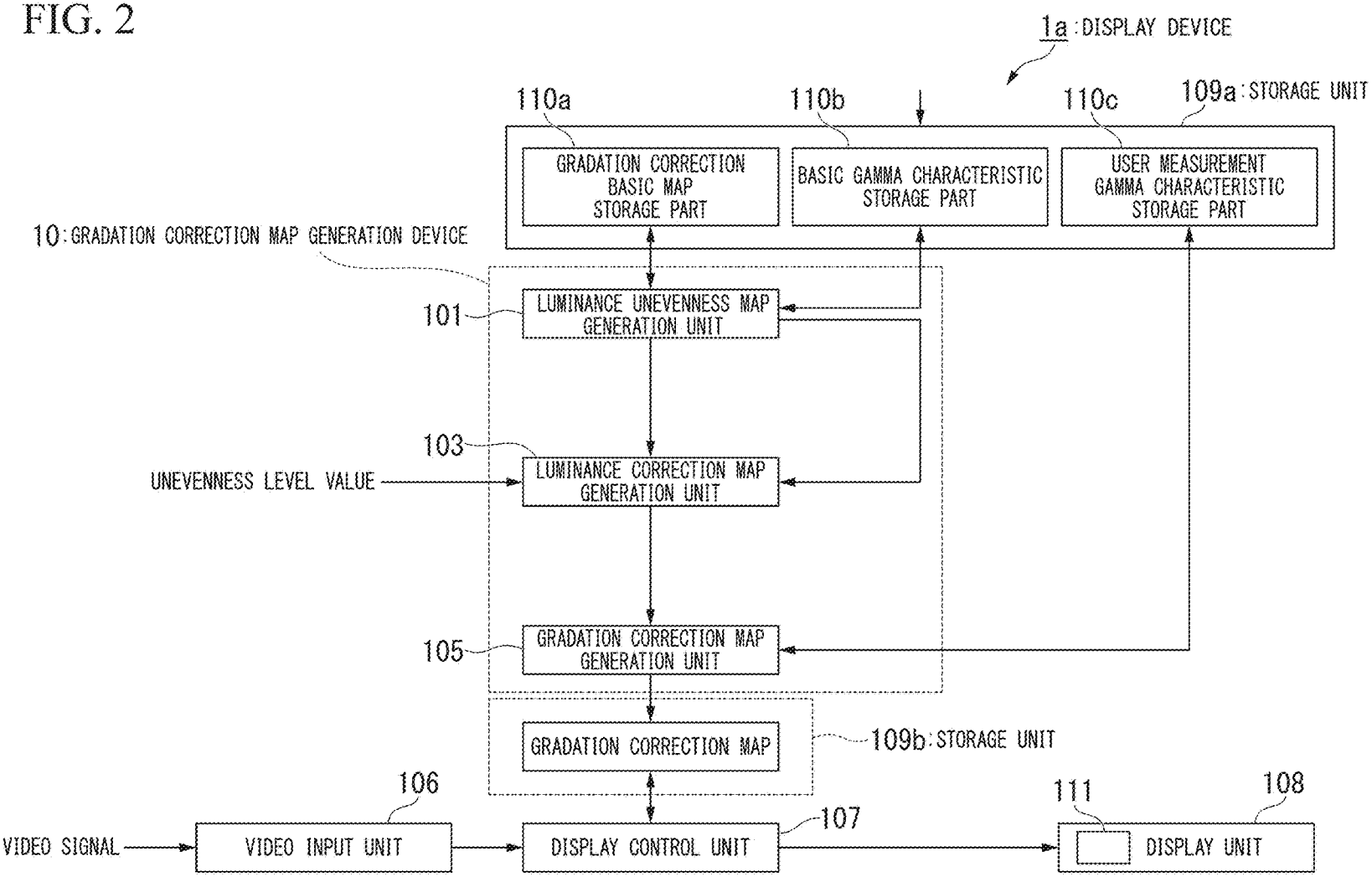
FIG. 2 is a diagram showing an example of a display device 1*a* according to a second embodiment of the present invention.

FIG. 2 is a diagram showing an example of a display device 1*a* according to the second embodiment of the present invention.

As shown in FIG. 2, the display device 1*a* of the second embodiment has a gradation correction map generation device 10, a video input unit 106, a display control unit 107, a display unit 108, a storage unit 109*a*, and a storage unit 109*b*.

The gradation correction map generation device 10 includes a luminance unevenness map generation unit 101, a luminance correction map generation unit 103, and a gradation correction map generation unit 105. The gradation correction map generation device 10 may be implemented by combining a microcomputer and firmware, or by using an FPGA (Field-Programmable Gate Array).

The luminance unevenness map generation unit 101 generates a luminance unevenness map according to a gradation correction basic map and a basic gamma characteristic which are stored in the storage unit 109*a*.

Here, the gradation correction basic map indicates a corresponding relationship between a plurality of positions on a screen of the display unit 108 and a gradation correction value for the video signal at each of the positions. In addition, the basic gamma characteristic (first gamma characteristic) indicates a corresponding relationship between (i) luminance at a specific position or the vicinity thereof on the screen of the display unit 108 at a first point in time prior to a second point in time and (ii) gradation of the video signal at the plurality of the positions.

If there is no data for the gradation correction basic map and the basic gamma characteristic corresponding to the relevant positions on the screen of the display unit 108, the luminance unevenness map generation unit 101 converts the gradation to the luminance by using data interpolated by linear interpolation or the like applied to the data for the gradation correction basic map and the data for the basic gamma characteristic.

The luminance unevenness map generation unit 101 computes a luminance unevenness map by converting each gradation, which has been corrected by using gradation correction values included in the gradation correction basic map, to luminance with reference to the basic gamma characteristic. Here, the luminance unevenness map indicates a corresponding relationship between each position on the screen of the display unit 108 when no correction is performed and uncorrected luminance which is luminance at that position when no correction is performed.

According to the luminance unevenness map computed by the luminance unevenness map generation unit 101, the luminance correction map generation unit 103 computes a target luminance unevenness map in accordance with an unevenness level value. Here, the unevenness level value is a parameter which indicates the level of the performed gradation correction for the video signal. The unevenness level value is any value which the user can select. The range of the unevenness level value may be 0% (no correction) to 100% (complete correction). The target luminance unevenness map is a luminance unevenness map which indicates the luminance (target luminance) at each position on the screen of the display unit 108, that is targeted in the gradation correction of the video signal. For example, the target luminance unevenness map when the unevenness level value is 0% (non-correction) is identical to the luminance unevenness map computed by the luminance unevenness map generation unit 101. When the unevenness level value is 100% (complete correction), the target luminance included in the target luminance unevenness map is identical to the lowest luminance in the luminance unevenness map computed by the luminance unevenness map generation unit 101. Furthermore, when the unevenness level value is between 0% and 100%, the target luminance included in the target luminance unevenness map is set to a value between the target luminance when the unevenness level value is 0% and the target luminance when the unevenness level value is 100%.

The luminance correction map generation unit 103 computes an amount of luminance correction according to the luminance unevenness map computed by the luminance unevenness map generation unit 101 and the computed target luminance unevenness map. The amount of luminance correction is a difference or ratio between the luminance included in the luminance unevenness map and the target luminance included in the target luminance unevenness map. For example, when the luminance included in the luminance unevenness map is 250 candela per square meter and the target luminance included in the target luminance unevenness map is 200 candela per square meter, the amount of luminance correction is 50 candela per square meter (i.e., 250−200) or 80% (i.e., 100×(200/250)). The luminance correction map generation unit 103 generates the luminance correction map by using the computed amount of luminance correction.

The gradation correction map generation unit 105 generates a gradation correction map according to the luminance correction map generated by the luminance correction map generation unit 103 and a user measurement gamma characteristic stored in the storage unit 109*a*. For example, the gradation correction map generation unit 105 computes luminance to be displayed after the correction, by using an amount of luminance correction which forms the luminance correction map, and converts the computed luminance to a gradation with reference to the user measurement gamma characteristic. The gradation correction map generation unit 105 further computes a correction value for the gradation according to the gradation obtained by the conversion, so as to compute the gradation correction map. The gradation correction map generation unit 105 stores the generated gradation correction map in the storage unit 109*b*.

The video input unit 106 receives a video signal. The video input unit 106 outputs the received video signal to the display control unit 107.

The display control unit 107 corrects the gradation of the video signal received from the video input unit 106 according to the gradation correction map stored in the storage unit 109*b*. The display control unit 107 uses the corrected video signal to make the display unit 108 display a video.

The display unit 108 has a gamma measurement unit 111 utilized to measure luminance when a video according to a video signal having a predetermined gradation is displayed on the relevant screen.

The storage unit 109*a* stores various data items utilized in the operation of the gradation correction map generation device 10. For example, the storage unit 109*a* includes a gradation correction basic map storage part 110*a* that stores the gradation correction basic map; a basic gamma characteristic storage part 110*b* that stores the basic gamma characteristic; and a user measurement gamma characteristic storage part 110*c* that stores the user measurement gamma characteristic. The storage unit 109*a* may be a non-volatile storage device such as a flash memory, EEPROM (Electrically Erasable Programmable Read-Only Memory), or the like.

The storage unit 109*b* stores various data items utilized in the operation of the display control unit 107. For example, the storage unit 109*b* stores the gradation correction map. The storage unit 109*a* may be a volatile storage device such as a RAM (Random Access Memory).

FIG. 3 is a diagram showing an example of data of the gradation correction basic map.

As shown in FIG. 3, the gradation correction basic map is a set of gradation correction values utilized to correct the luminance unevenness for each of gradation values and each of a plurality of positions. This gradation correction basic map has gradation correction values utilized to cancel luminance unevenness measured at a first point in time, which may be when manufacturing or factory adjustment is performed. For example, as shown in FIG. 3, the gradation values are 255, 192, 128, 64, 0 taken at regular intervals of 64 between 0 to 255. For the plurality of positions, the coordinates of the upper-left corner of the screen of the display unit 108 is set to the origin, and 20 x-coordinate values are taken at regular intervals in the x-axis direction and 11 y-coordinate values are taken in the y-axis direction, where combinations between the 20 x-coordinate values and the 11 y-coordinate values indicate the above positions on the screen.

The gradation correction values may by absolute values for each gradation value, or may be gradation values subtracted from each gradation value. For example, in FIG. 3, the gradation correction values are indicated by absolute values. In this case, for the gradation value of 255, the gradation correction value at a position on the screen of the display unit 108 indicated by an x-coordinate value of x1 and a y-coordinate value of y1 is a correction value to change the gradation value from 255 to 230. If a similar correction is performed when the gradation correction values are indicated by gradation values subtracted from each gradation value, then for the gradation value of 255, the gradation correction value at a position on the screen of the display unit 108 indicated by an x-coordinate value of x1 and a y-coordinate value of y1 is −25.

In addition, the gradation correction basic map may be generated for each single color of R (Red), G (Green), and B (Blue). When such a gradation correction basic map is used, luminance unevenness and color unevenness on the screen of the display unit 108 can be corrected. The gradation correction basic map may be generated for a single color of monochrome. When such a gradation correction basic map is used, only luminance unevenness on the screen of the display unit 108 can be corrected.

Figure 4:
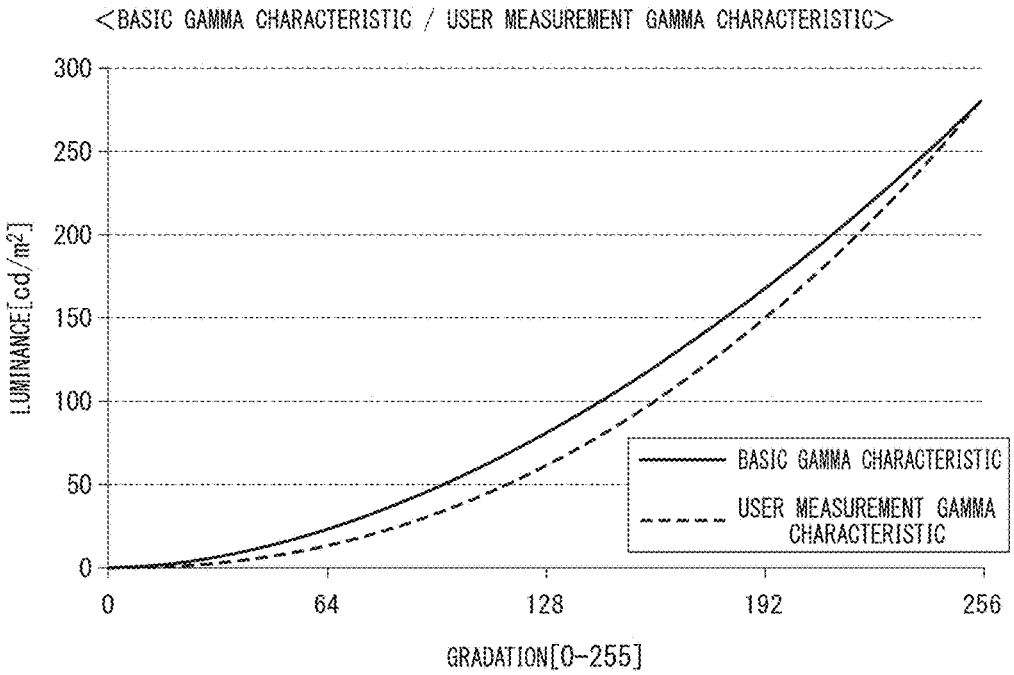
FIG. 4 is a diagram showing an example of the basic gamma characteristic and the user measurement gamma characteristic.

FIG. 4 is a diagram showing an example of the basic gamma characteristic and the user measurement gamma characteristic.

In FIG. 4, the horizontal axis indicates the gradation for the video signal, and the vertical axis indicates the luminance.

The gamma characteristic is data which indicates a corresponding relationship between the gradation of an input video signal and luminance of the screen of the display unit 108.

The basic gamma characteristic is a gamma characteristic at each position on the screen of the display unit 108, for which the gradation correction basic map was generated at the first point in time. That is, for a specific position on the screen of the display unit 108, the basic gamma characteristic as shown in FIG. 4 is stored. The user measurement gamma characteristic is a gamma characteristic obtained by measuring the luminance at a specific position on the screen of the display unit 108, at a second point of time after the first point of time. That is, for the specific position on the screen of the display unit 108, the gamma characteristic measured by the user at the second point of time after the first point of time as shown in FIG. 4 is stored as the user measurement gamma characteristic. Here, the user measurement gamma characteristic may be a gamma characteristic measured by the user for a position on the screen of the display unit 108. On a viewpoint of the degree of correction of the luminance unevenness, it is preferable that the position on the screen of the display unit 108, at which the user measures the user measurement gamma characteristic, be identical to the position on the screen of the display unit 108, at which the basic gamma characteristic was measured.

Figure 5:
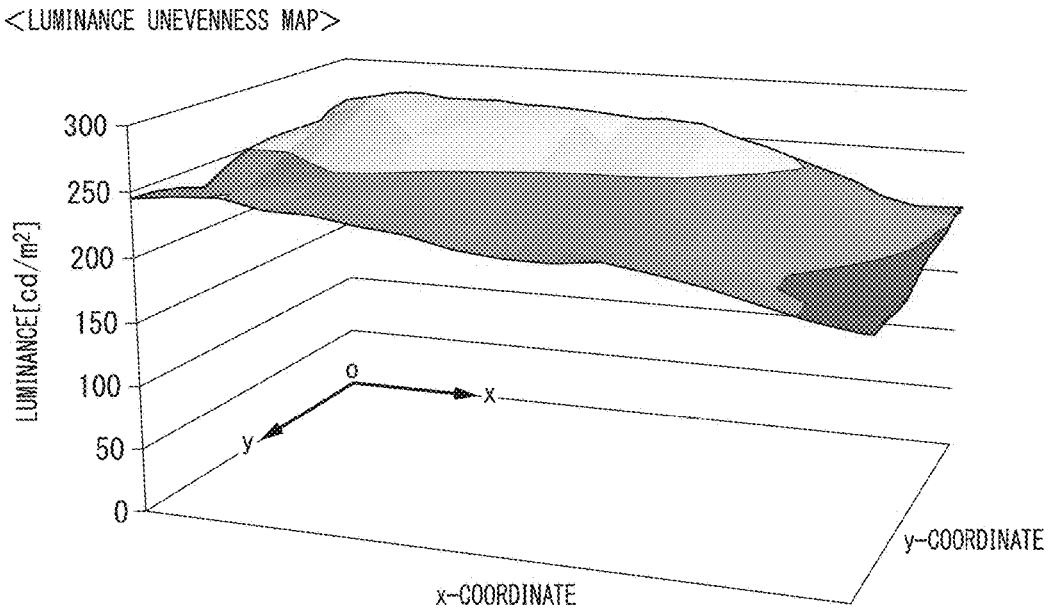
FIG. 5 is a diagram showing an example of the luminance unevenness map.

FIG. 5 is a diagram showing an example of the luminance unevenness map.

In FIG. 5, "x-axis" is a coordinate axis in the horizontal direction of the display unit 108, and "y-axis" is a coordinate axis in the vertical direction of the display unit 108. The origin is present at the upper-left corner of the screen of the display unit 108, and x-coordinate and y-coordinate are coordinates on the screen of the display unit 108. In addition, "luminance" is luminance at each position on the screen, which is indicated by the x-coordinate and the y-coordinate.

The luminance unevenness map is a set of data which indicate luminance at each position on the screen of the display unit 108 at the first point in time (when the gradation correction basic map as shown in FIG. 3 and the basic gamma characteristic as shown in FIG. 4 are generated) prior to the second point in time. Generally, when the display unit 108 is a liquid crystal panel, as shown in FIG. 5, a central portion of the screen tends to be brighter than the other portions.

The luminance unevenness map generation unit 101 computes the luminance unevenness map from the gradation correction basic map, which is generated according to the luminance unevenness map, and the basic gamma characteristic.

Although the luminance unevenness map is shown visually in FIG. 5, actually, the luminance unevenness map is not image data but a data table. That is, similar to the gradation correction basic map shown in FIG. 3, the luminance unevenness map is stored in the storage unit 109*a* as luminance data associated with the x-coordinate and the y-coordinate.

Figure 6:
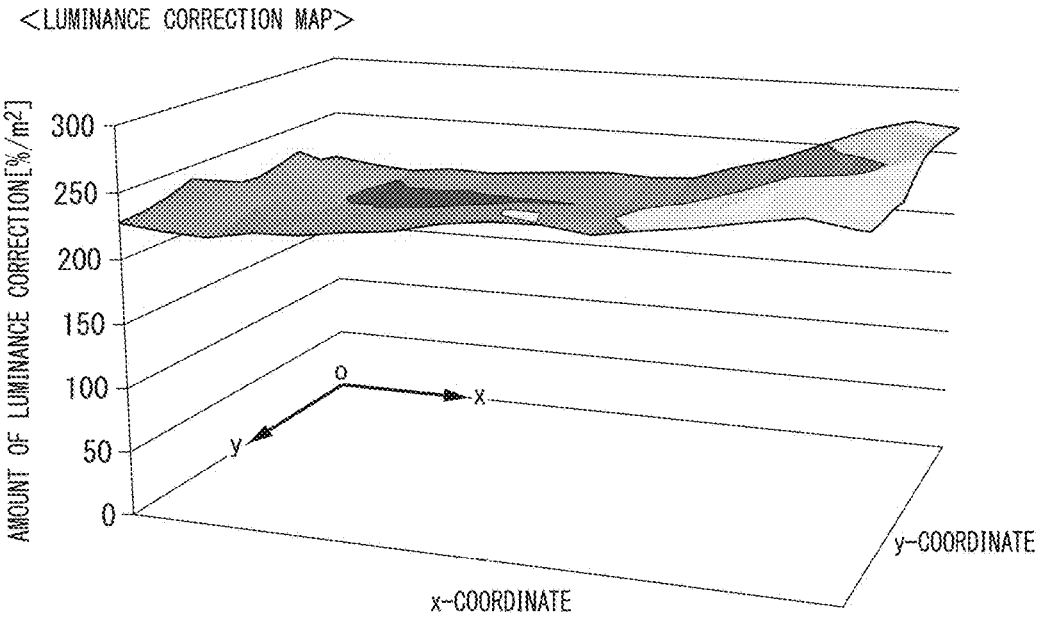
FIG. 6 is a diagram showing an example of the luminance correction map.

FIG. 6 is a diagram showing an example of the luminance correction map.

In FIG. 6, "x-axis" is a coordinate axis in the horizontal direction of the display unit 108, and "y-axis" is a coordinate axis in the vertical direction of the display unit 108. The origin is present at the upper-left corner of the screen of the display unit 108, and x-coordinate and y-coordinate are coordinates on the screen of the display unit 108. In addition, "amount of luminance correction" is an amount of luminance correction in a range from 0% (non-correction) to 100% (complete correction) at each position on the screen, which is indicated by the x-coordinate and the y-coordinate.

The luminance correction map is a set of data which indicates a corresponding relationship between the amount of luminance correction at each position on the screen of the display unit 108 and said each position on the screen of the display unit 108.

The luminance correction map generation unit 103 generates the luminance correction map according to the luminance unevenness map computed by the luminance unevenness map generation unit 101 and the computed target luminance unevenness map.

Although the luminance correction map is shown visually in FIG. 6, actually, the luminance correction map is not image data but a data table. That is, similar to the gradation correction basic map shown in FIG. 3, the luminance correction map is stored in the relevant storage unit as data of the amount of luminance correction associated with the x-coordinate and the y-coordinate.

FIG. 7 is a diagram showing an example of data of the gradation correction map.

As shown in FIG. 7, the gradation correction map is a set of gradation correction values utilized to correct the luminance unevenness for each of gradation values and each of a plurality of positions.

This gradation correction map has gradation correction values utilized to cancel temporally changed luminance unevenness measured at the second point in time after the first point in time or luminance unevenness caused by a change in temperature around the display device 1*a*. For example, as shown in FIG. 7, the gradation values are 255, 192, 128, 64, 0 taken at regular intervals of 64 between 0 to 255. For the plurality of positions, the coordinates of the upper-left corner of the screen of the display unit 108 is set to the origin, and 20 x-coordinate values are taken at regular intervals in the x-axis direction and 11 y-coordinate values are taken in the y-axis direction, where combinations between the 20 x-coordinate values and the 11 y-coordinate values indicate the above positions on the screen.

The gradation correction map generation unit 105 generates the map according to the user measurement gamma characteristic and the luminance correction map. The user measurement gamma characteristic is a gamma characteristic measured by the user for a specific position on the screen of the display unit 108 at the second point in time after the first point in time which may be when manufacturing or factory adjustment is performed.

The gradation correction values may by absolute values for each gradation value, or may be gradation values subtracted from each gradation value.

In addition, the gradation correction basic map may be generated for each single color of R (Red), G (Green), and B (Blue). When such a gradation correction basic map is used, luminance unevenness and color unevenness on the screen of the display unit 108 can be corrected. The gradation correction basic map may be generated for a single color of monochrome. When such a gradation correction basic map is used, only luminance unevenness on the screen of the display unit 108 can be corrected.

Figure 8:
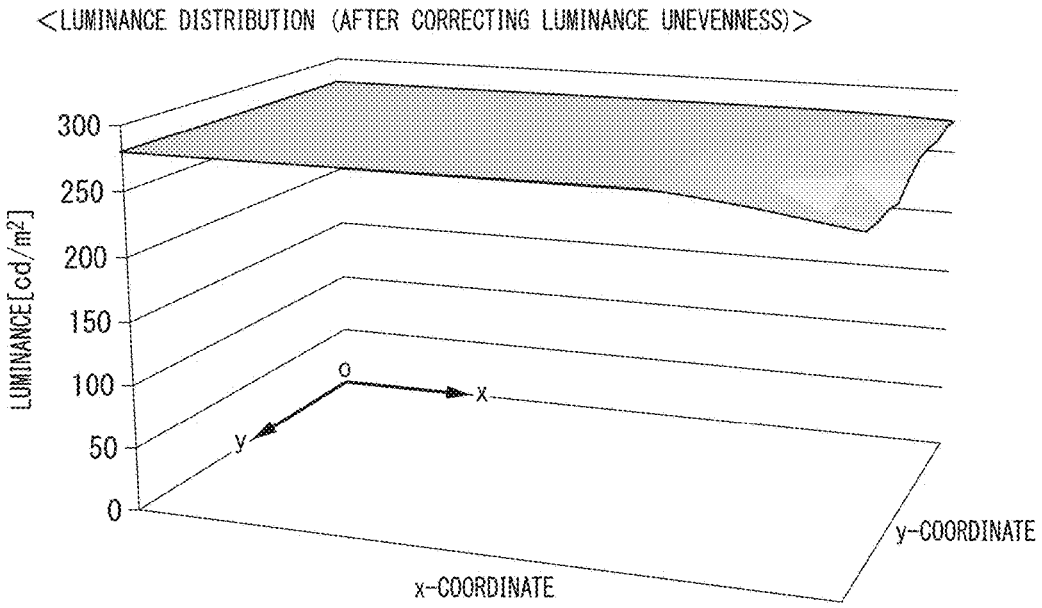
FIG. 8 is a diagram showing an example of luminance distribution over the entire screen of the display unit after correcting the luminance unevenness.

FIG. 8 is a diagram showing an example of luminance distribution over the entire screen of the display unit 108 after correcting the luminance unevenness.

In FIG. 8, "x-axis" is a coordinate axis in the horizontal direction of the display unit 108, and "y-axis" is a coordinate axis in the vertical direction of the display unit 108. The origin is present at the upper-left corner of the screen of the display unit 108, and x-coordinate and y-coordinate are coordinates on the screen of the display unit 108. In addition, "luminance" is the luminance at each position on the screen, which is indicated by the x-coordinate and the y-coordinate.

The luminance distribution over the entire screen of the display unit 108 after correcting the luminance unevenness is a luminance distribution obtained when the display control unit 107 corrects the gradation of a video signal received from the video input unit 106 according to the gradation correction map as shown in FIG. 7.

The luminance is uniform over the entire screen, which shows that the luminance unevenness has been corrected.

Figure 9:
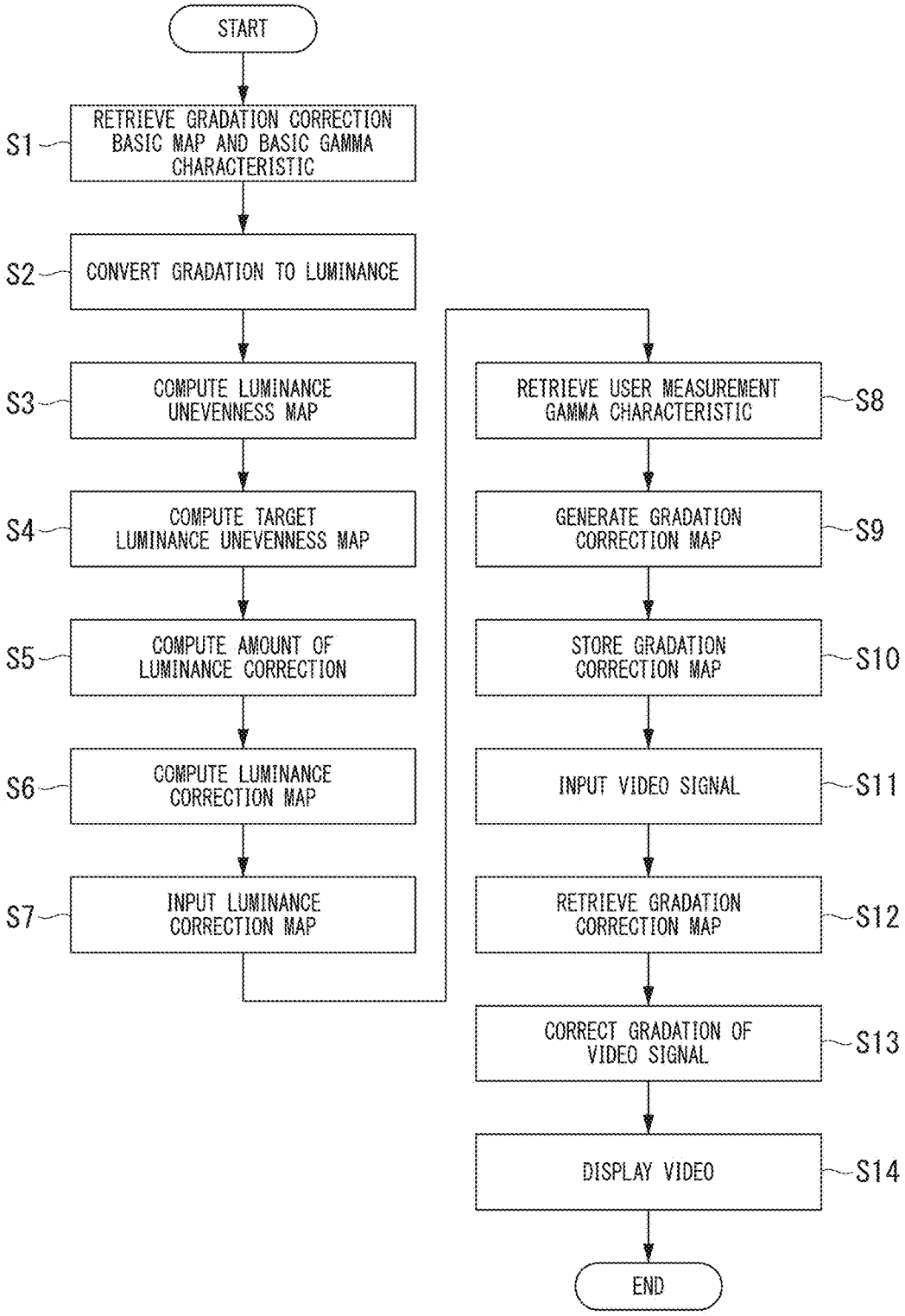
FIG. 9 is a diagram showing an example of the operation flow of the display device 1 according to the second embodiment of the present invention.

FIG. 9 is a diagram showing an example of the operation flow of the display device 1*a* according to the second embodiment of the present invention.

The operation of the display device 1*a* of the second embodiment will be explained below.

An external device (e.g., personal computer) other than the display device 1*a* images luminance unevenness generated on the screen of the display unit 108 at the first point in time prior to the second point in time, by using a high-precision camera or the like. The external device then obtains each relevant position on the screen of the display unit 108 and the luminance at the position. According to the obtained luminance, the external device determines a gradation correction basic map which reproduces the luminance unevenness imaged by the high-precision camera or the like, and the gamma characteristic at that point in time.

For example, when a video signal having a single color of complete white is input in manufacturing or factory adjustment, a gradation correction basic map and a basic gamma characteristic are determined, which reproduce the luminance unevenness that indicates a corresponding relationship between each position on the screen of the display unit 108 and the luminance at the position.

The external device stores the determined gradation correction basic map and basic gamma characteristic in the storage unit 109*a*.

The storage unit 109*a* also stores the user measurement gamma characteristic measured by the user at the second point in time after the first point in time. The external device stores the basic gamma characteristic, which was determined at the first point in time prior to the second point in time, as the initial value of the user measurement gamma characteristic in the storage unit 109*a*.

The luminance unevenness map generation unit 101 retrieves the gradation correction basic map and the basic gamma characteristic from the storage unit 109*a* (see step S1). According to the retrieved gradation correction basic map and basic gamma characteristic, the luminance unevenness map generation unit 101 converts the gradation at each position on the screen of the display unit 108 to the luminance (see step S2).

The luminance unevenness map generation unit 101 computes the luminance unevenness map according to the luminance at each position on the screen of the display unit 108 (see step S3). For example, this luminance unevenness map is the luminance unevenness map shown in FIG. 5.

The luminance unevenness map generation unit 101 outputs the computed luminance unevenness map to the luminance correction map generation unit 103.

The luminance correction map generation unit 103 receives the luminance unevenness map from the luminance unevenness map generation unit 101. The luminance correction map generation unit 103 also receives an unevenness level value desired by the user. According to the unevenness level value and the received luminance unevenness map, the luminance correction map generation unit 103 computes a target luminance unevenness map utilized to perform the luminance unevenness correction from 0% (non-correction) to 100% (complete correction) (see step S4).

For example, the luminance correction map generation unit 103 computes a target luminance unevenness map by which luminance unevenness correction of 100% level is performed where the luminance at each position on the screen of the display unit 108 as shown in FIG. 5 becomes identical to the lowest luminance among the individual positions.

Additionally, the luminance correction map generation unit 103 computes the amount of luminance correction at each position on the screen of the display unit 108 from the ratio of the target luminance unevenness map to the received luminance unevenness map (see step S5).

For example, if the received luminance unevenness map indicates 250 candela per square meter and the target luminance unevenness map indicates 200 candela per square meter, the computed amount of luminance correction is 80% (i.e., 100×(200/250)).

According to the amount of luminance correction at each position on the screen of the display unit 108, the luminance correction map generation unit 103 computes the luminance correction map which is a set of the amounts of luminance correction (see step S6).

The luminance correction map generation unit 103 outputs the generated luminance correction map to the gradation correction map generation unit 105.

The gradation correction map generation unit 105 receives the luminance correction map from the luminance correction map generation unit 103 (see step S7). The gradation correction map generation unit 105 also retrieves the user measurement gamma characteristic stored in the storage unit 109*a* (see step S8). This user measurement gamma characteristic stored in the storage unit 109*a* is a gamma characteristic measured by the user at the second point in time after the first point in time. For example, the display unit 108 obtains the user measurement gamma characteristic by reading a test pattern for video displayed on a portion of the screen of the display unit 108 by using the gamma measurement unit 111 which is provided in the display unit 108 and operated by the user.

The gamma measurement unit 111 utilized to read the test pattern for video may be built in the display unit 108 or may be provided inside the frame of the display unit 108 and appear outside when the gamma measurement unit 111 is used. In addition, the gamma measurement unit 111 utilized to read the test pattern for video may extend from the rear surface of the display unit 108. The gamma measurement unit 111 as an external unit, which is not provided in the display unit 108, may also be used. When the display unit 108 provides the gamma measurement unit 111 to read the test pattern for video, the display unit 108 may display the test pattern for video at a position on the screen according to the position of the gamma measurement unit 111. Additionally, the position on the screen where the display unit 108 displays the test pattern for video may be any position within a range in which the test pattern can be appropriately read. On a viewpoint of the degree of correction of the luminance unevenness, it is preferable that the position on the screen of the display unit 108, at which the user measures the user measurement gamma characteristic, be identical to the position on the screen of the display unit 108, at which the basic gamma characteristic was measured.

The display unit 108 stores the obtained user measurement gamma characteristic in the storage unit 109*a*.

The gradation correction map generation unit 105 generates the gradation correction map by converting the luminance in the received luminance correction map to the gradation by using the user measurement gamma characteristic retrieved from the storage unit 109*a* (see step S9).

The gradation correction map generation unit 105 stores the generated gradation correction map in the storage unit 109*b* (see step S10).

The video input unit 106 receives a video signal (see step S11). The video input unit 106 outputs the received video signal to the display control unit 107.

When the display control unit 107 receives the video signal from the video input unit 106, the display control unit 107 retrieves the gradation correction map from the storage unit 109*b* (see step S12). The display control unit 107 corrects the gradation of the received video signal by using the gradation correction map retrieved from the storage unit

109*b* (see step S13). The display control unit 107 uses the corrected video signal to make the display unit 108 display a video (see step S14).

The operation of the display device 1*a* according to the second embodiment of the present invention has been explained. According to the display device 1*a*, the gradation correction map generation device 10 includes the luminance unevenness map generation unit 101, the luminance correction map generation unit 103, and the gradation correction map generation unit 105, and the video input unit 106, the display control unit 107, the display unit 108, the storage unit 109*a*, and the storage unit 109*b* are also provided.

According to the gradation correction basic map and the basic gamma characteristic, which are stored in the storage unit 109*a* and obtained in the first point in time prior to the second point in time, the luminance unevenness map generation unit 101 converts the gradation in the gradation correction basic map to the luminance. According to the data about the conversion from the gradation in the gradation correction basic map to the luminance, the luminance unevenness map generation unit 101 computes the luminance unevenness map. The luminance correction map generation unit 103 computes the target luminance unevenness map according to the luminance unevenness map computed by the luminance unevenness map generation unit 101 and the unevenness level map. The luminance correction map generation unit 103 then computes the luminance correction map according to the luminance unevenness map computed by the luminance unevenness map generation unit 101 and the computed target luminance unevenness map. The gradation correction map generation unit 105 generates the gradation correction map according to the luminance correction map generated by the luminance correction map generation unit 103 and the user measurement gamma characteristic obtained at the second point in time after the first point in time.

Accordingly, in the display device 1*a* of the second embodiment, the gradation correction map generation unit 105 can simply generate the gradation correction map according to the luminance correction map and the user measurement gamma characteristic obtained at the second point in time after the first point in time and store the generated map in the storage unit 109*b*.

In addition, according to the gradation correction map stored in the storage unit 109*b*, the display control unit 107 corrects the gradation of the video signal received from the video input unit 106 and makes the display unit 108 display a video.

Accordingly, the display device 1*a* of the second embodiment corrects the gradation according to the user measurement gamma characteristic at a specific position on the screen of the display unit 108. Therefore, it is possible to simply correct the luminance unevenness over the entire screen of the display unit 108.

In addition, the storage unit 109*a* stores the gradation correction basic map for each of R, G, and B, and the gradation correction map generation device 10 generates the gradation correction map for each of the gradation correction basic maps for R, G, and B.

Accordingly, the display device 1*a* of the second embodiment can implement a display performance to reproduce uniform colors over the entire screen of the display unit 108.

Next, a display device 1*b* according to a third embodiment of the present invention will be explained with reference to the drawings.

Figure 10:
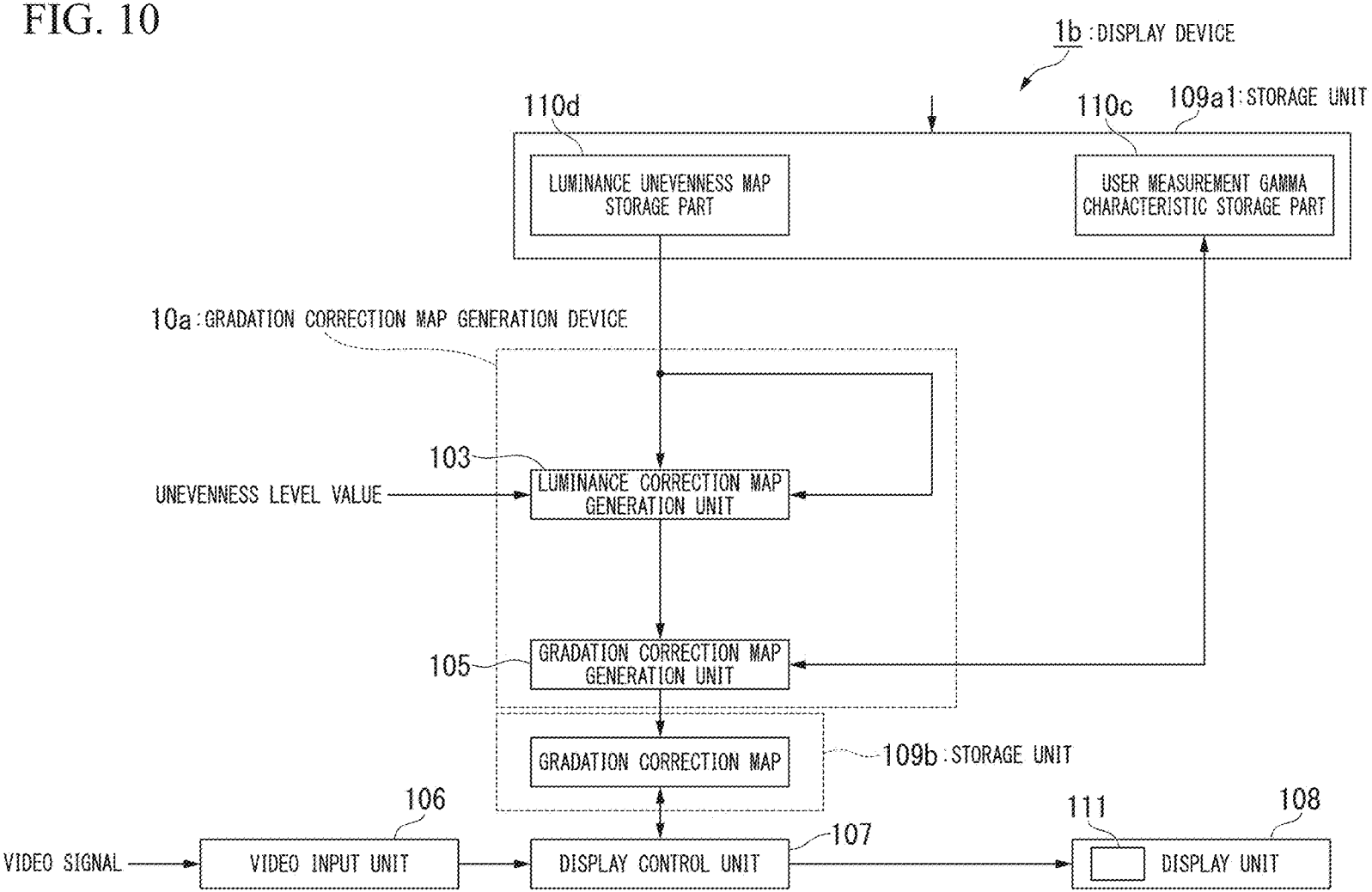
FIG. 10 is a diagram showing an example of the display device 1 according to the third embodiment of the present invention.

FIG. 10 is a diagram showing an example of the display device 1*b* according to the third embodiment of the present invention.

As shown in FIG. 10, the display device 1*b* of the third embodiment has a gradation correction map generation device 10*a*, a video input unit 106, a display control unit 107, a display unit 108, a storage unit 109*a*1, and a storage unit 109*b*.

The gradation correction map generation device 10*a* includes a luminance correction map generation unit 103 and a gradation correction map generation unit 105. The storage unit 109*a*1 includes a luminance unevenness map storage part 110*d* that stores a luminance unevenness map and a user measurement gamma characteristic storage part 110*c* that stores the user measurement gamma characteristic. The luminance unevenness map stored in the storage unit 109*a*1 is a set of data obtained by imaging luminance unevenness, which is generated on the screen of the display unit 108 at a first point in time prior to a second point in time, by using a high-precision camera or the like, where an external device other than the display device 1*b* obtains individual positions on the screen of the display unit 108 and luminance at each of the positions. The external device stores the obtained set of data in the storage unit 109*a*1. The luminance unevenness map stored in the storage unit 109*a*1 may be data at specific positions thinned out from the individual positions. In such a case, if there is no data of the luminance unevenness map corresponding to some positions on the screen of the display unit 108, the luminance correction map generation unit 103 computes a target luminance unevenness map by using data obtained by interpolating data of the luminance unevenness map by using linear interpolation or the like. Additionally, if there is no data of the luminance unevenness map corresponding to some positions on the screen of the display unit 108, the luminance correction map generation unit 103 computes a luminance correction map by using data obtained by interpolating data of the luminance unevenness map and the target luminance unevenness map by using linear interpolation or the like.

In the third embodiment, operation corresponding to steps S1 to S3 executed by the display device 1*a* of the second embodiment may be performed by an external device.

In this case, the display device 1*b* of the third embodiment executes an operation from step S4 to step S14 which are executed by the display device 1*a* of the second embodiment.

The operation of the display device 1*b* according to the third embodiment of the present invention has been explained above. In accordance with the above display device 1*b*, the gradation correction map generation device 10*a* includes the luminance correction map generation unit 103 and the gradation correction map generation unit 105. The video input unit 106, the display control unit 107, the display unit 108, the storage unit 109*a*1, and the storage unit 109*b* are also provided.

The luminance correction map generation unit 103 computes the target luminance unevenness map according to the luminance unevenness map stored by the external device and the unevenness level value. The luminance correction map generation unit 103 generates the luminance correction map according to the luminance unevenness map retrieved from the storage unit 109*a*1 and the computed target luminance unevenness map. The gradation correction map generation unit 105 generates the gradation correction map according to the luminance correction map generated by the luminance correction map generation unit 103 and the user measurement gamma characteristic obtained at the second point in time after the first point in time.

Accordingly, the gradation correction map generation unit 105 in the display device 1*b* of the third embodiment can simply generate the gradation correction map according to the luminance correction map and the user measurement gamma characteristic obtained at the second point in time after the first point in time and store the generated map in the storage unit 109*b*.

In addition, according to the gradation correction map stored in the storage unit 109*b*, the display control unit 107 corrects the gradation of the video signal received from the video input unit 106 and makes the display unit 108 display a video.

Accordingly, the display device 1*b* of the third embodiment corrects the gradation according to the user measurement gamma characteristic at a specific position on the screen of the display unit 108. Therefore, it is possible to simply correct the luminance unevenness over the entire screen of the display unit 108.

In addition, the storage unit 109*a*1 stores the gradation correction basic map for each of R, G, and B, and the gradation correction map generation device 10*a* generates the gradation correction map for each of the gradation correction basic maps for R, G, and B.

Accordingly, the display device 1*b* of the third embodiment can implement a display performance to reproduce uniform colors over the entire screen of the display unit 108.

Next, a display device 1*c* according to a fourth embodiment of the present invention will be explained with reference to the drawings.

Figure 11:
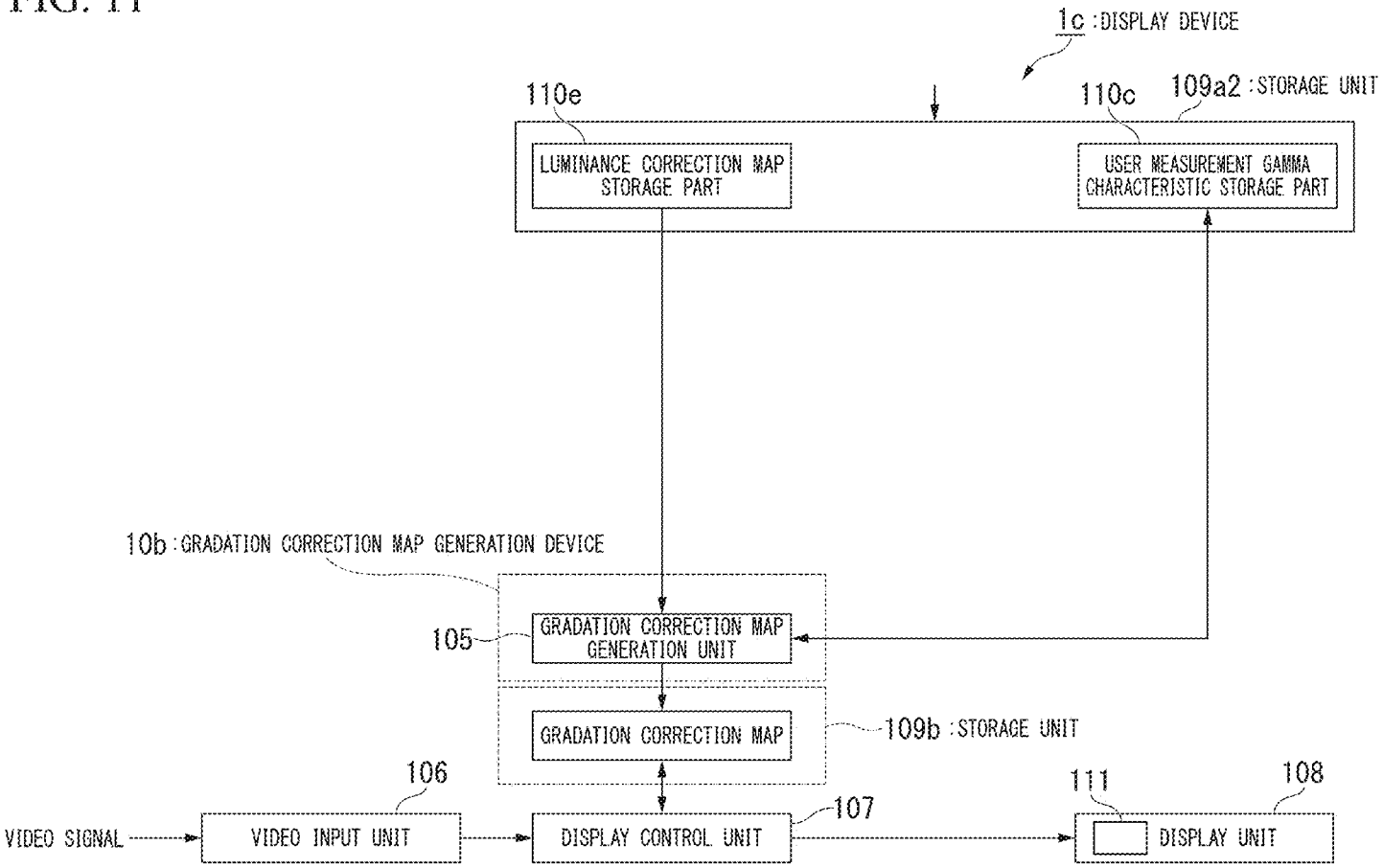
FIG. 11 is a diagram showing an example of the display device 1 according to the fourth embodiment of the present invention.

FIG. 11 is a diagram showing an example of the display device 1*c* according to the fourth embodiment of the present invention.

As shown in FIG. 11, the display device 1*c* of the fourth embodiment has a gradation correction map generation device 10*b*, a video input unit 106, a display control unit 107, a display unit 108, a storage unit 109*a*2, and a storage unit 109*b*.

The gradation correction map generation device 10*b* includes a gradation correction map generation unit 105. The storage unit 109*a*2 includes a luminance correction map storage part 110*e* that stores a luminance correction map and a user measurement gamma characteristic storage part 110*c* that stores a user measurement gamma characteristic. The luminance correction map stored in the luminance correction map storage part 110*e* is a set of data obtained by imaging luminance unevenness, which is generated on the screen of the display unit 108 at a first point in time prior to a second point in time, by using a high-precision camera or the like, where an external device other than the display device 1*c* obtains individual positions on the screen of the display unit 108 and luminance at each of the positions. The external device has a luminance correction map generation unit, generates a luminance correction map according to an obtained luminance unevenness map, and stores the generated luminance correction map in the storage unit 109*a*2.

In the fourth embodiment, operation corresponding to steps S1 to S6 executed by the display device 1*a* of the second embodiment are performed by an external device.

Therefore, the display device 1*c* of the fourth embodiment executes an operation from step S7 to S14 which are executed by the display device 1*a* of the second embodiment.

The operation of the display device 1*c* according to the fourth embodiment of the present invention has been explained above. In accordance with the above display device 1*c*, the gradation correction map generation device 10*b* includes the gradation correction map generation unit 105. The video input unit 106, the display control unit 107, the display unit 108, the storage unit 109*a*2, and the storage unit 109*b* are also provided.

The gradation correction map generation unit 105 generates the gradation correction map according to the luminance correction map generated by an external device and the user measurement gamma characteristic obtained at the second point in time after the first point in time.

Accordingly, the gradation correction map generation unit 105 in the display device 1*c* of the fourth embodiment can simply generate the gradation correction map according to the luminance correction map and the user measurement gamma characteristic obtained at the second point in time after the first point in time and store the generated map in the storage unit 109*b*.

In addition, according to the gradation correction map stored in the storage unit 109*b*, the display control unit 107 corrects the gradation of the video signal received from the video input unit 106 and makes the display unit 108 display a video.

Accordingly, the display device 1*c* of the fourth embodiment corrects the gradation according to the user measurement gamma characteristic at a specific position on the screen of the display unit 108. Therefore, it is possible to simply correct the luminance unevenness over the entire screen of the display unit 108.

In addition, the storage unit 109*a*2 stores the gradation correction basic map for each of R, G, and B, and the gradation correction map generation device 10*b* generates the gradation correction map for each of the gradation correction basic maps for R, G, and B.

Accordingly, the display device 1*c* of the fourth embodiment can implement a display performance to reproduce uniform colors over the entire screen of the display unit 108.

The storage unit 109, the storage unit 109*a*1, the storage unit 109*a*2, and the storage unit 109*b* according to the present invention each may be provided anywhere if appropriate information communication can be performed. In addition, for each of the storage unit 109, the storage unit 109*a*1, the storage unit 109*a*2, the storage unit 109*b*, the gradation correction basic map storage part 110*a*, the basic gamma characteristic storage part 110*b*, and the user measurement gamma characteristic storage part 110*c*, a plurality of units or parts may be provided to perform distributed data storage if appropriate information communication can be performed.

In the operation flow in the embodiments of the present invention, the order of executing the steps may be changed if the operation is appropriately performed.

The embodiments of the present invention have been explained above. The above-described gradation correction map generation unit 105, the gradation correction map generation device 10, the gradation correction map generation device 10*a*, the gradation correction map generation device 10*b*, the display device 1, the display device 1*a*, the display device 1*b*, and the display device 1*c* each include a computer system. The steps of the above-described operation are stored as a program in a computer-readable storage medium, and the operation is performed when the relevant computer loads and executes the program. The above computer readable storage medium is a magnetic disk, magneto optical disk, CD-ROM, DVD-ROM, semiconductor memory, or the like. In addition, the relevant computer program may be provided to a computer via a communication line, and the computer which received the program may execute the program.

In addition, the program may execute a part of the above-explained functions, or may be a program (so-called "differential file" (or "differential program")) by which the above-described functions can be executed by a combination of this program and an existing program which has already been stored in the relevant computer system.

While some embodiments of the present invention have been explained, these are exemplary embodiments and are not to be considered as limiting the scope of the invention. Various omissions, substitutions, and other modifications can be made without departing from the scope of the present invention.

INDUSTRIAL APPLICABILITY

In accordance with the display device, the gradation correction map generation device, the gradation correction map generation method, and the program according to the present invention, the display device 1 in the first embodiment can simply correct luminance unevenness over the entire screen of the display unit 108 by correcting the gradation according to the user measurement gamma characteristic at a specific position on the screen of the display unit 108.

REFERENCE SYMBOLS

1, 1*a*, 1*b*, 1*c* display device

The invention claimed is:

1. A display device comprising:

a video input unit that receives a video signal;

a display control unit that corrects the video signal;

a display unit that displays a video according to the corrected video signal on a screen; and a gradation correction map generation device, which further includes:

a luminance unevenness map generation unit that generates a luminance unevenness map which indicates a relationship between a plurality of the positions on the screen and uncorrected values of luminance, at the plurality of positions with reference to a gradation correction basic map which indicates a relationship between the plurality of the positions on the screen and correction values for gradation of the video signal at the plurality of the positions and a first gamma characteristic which indicates a relationship between luminance at/around a specific position on the screen at a first time and gradation of the video signal; and a gradation correction map generation unit that generates a gradation correction map which indicates a relationship between the plurality of positions on the screen and the correction values for gradation of the video signal at the plurality of the positions with reference to the luminance unevenness map and a second gamma characteristic which indicates a relationship between luminance at the specific position on the screen at a second time after the first time and gradation of the video signal, wherein the display control unit corrects the video signal with reference to the gradation correction map.

2. The display device according to claim 1, further comprising:

a luminance unevenness map storage unit that stores the luminance unevenness map.

3. The display device according to claim 1, further comprising:

a gradation correction basic map storage unit that stores the gradation correction basic map.

4. The display device according to claim 1, wherein the gradation correction map generation device further includes a luminance correction map generation unit that generates a luminance correction map which indicates a relationship between the plurality of positions on the screen and corrected values of luminance at the plurality of positions with reference to the luminance unevenness map, and wherein the gradation correction map generation unit generates the gradation correction map with reference to the second gamma characteristic and the luminance correction map at a designated unevenness level.

5. The display device according to claim 4, further comprising:

a luminance correction map storage unit that stores the luminance correction map.

6. The display device according to claim 4, wherein the corrected values of luminance represent is a difference or a ratio between the uncorrected values of luminance and target values of luminance.

7. The display device according to claim 1, further comprising:

a gamma measurement unit that measures luminance when a video according to a video signal having a specific gradation is displayed on the screen, wherein the second gamma characteristic is obtained according to the luminance measured by the gamma measurement unit.

8. A gradation correction map generation device comprising:

a luminance unevenness map generation unit that generates a luminance unevenness map which indicates a relationship between a plurality of positions on a screen of a display device and uncorrected values of luminance at the plurality of positions with reference to a gradation correction basic map which indicates a relationship between the plurality of the positions on the screen and the correction values for gradation of the video signal at the plurality of the positions and a first gamma characteristic which indicates a relationship between luminance at/around a specific position on the screen at a first time and gradation of the video signal; and a gradation correction map generation unit that generates a gradation correction map which indicates a relationship between the plurality of positions on the screen and correction values for gradation of the video signal at the plurality of the positions with reference to the luminance unevenness map and a second gamma characteristic which indicates a relationship between luminance at the specific position on the screen at a second time and gradation of the video signal, and wherein the gradation correction map is used to correct the video signal.

9. A gradation correction map generation method comprising:

generating a luminance unevenness map which indicates a relationship between a plurality of positions on a screen of a display device and uncorrected values of luminance at the plurality of positions with reference to a gradation correction basic map which indicates a relationship between the plurality of the positions on the screen and correction values for gradation of the video signal at the plurality of the positions and a first gamma characteristic which indicates a relationship between luminance at/around a specific position on the screen at a first time and gradation of the video signal; and generating a gradation correction map which indicates a relationship between the plurality of positions on the screen and the correction values for gradation of the video signal at the plurality of the positions with reference to the luminance unevenness map and a second gamma characteristic which indicates a relationship between luminance at the specific position on the screen at a second time and gradation of the video signal, the method further comprising correcting the video signal with reference to the gradation correction map.

10. A non-transitory computer readable medium having stored a program causing a computer to implement the gradation correction map generation method according to claim 9.

* * * * *